US011774209B2

(12) United States Patent
Szydlowski et al.

(10) Patent No.: US 11,774,209 B2
(45) Date of Patent: Oct. 3, 2023

(54) DEFLECTING DEVICE

(71) Applicant: RHEINMETALL LANDSYSTEME GMBH, Unterlüß (DE)

(72) Inventors: Nico Szydlowski, Celle (DE); Robert Buda, Celle (DE)

(73) Assignee: RHEINMETALL LANDSYSTEME GMBH, Unterlüß (DE)

( * ) Notice: Subject to any disclaimer, the term of this patent is extended or adjusted under 35 U.S.C. 154(b) by 0 days.

(21) Appl. No.: 17/639,360

(22) PCT Filed: Jul. 31, 2020

(86) PCT No.: PCT/EP2020/071622
§ 371 (c)(1),
(2) Date: Mar. 1, 2022

(87) PCT Pub. No.: WO2021/047822
PCT Pub. Date: Mar. 18, 2021

(65) Prior Publication Data

US 2022/0299287 A1 Sep. 22, 2022

(30) Foreign Application Priority Data

Sep. 11, 2019 (DE) ..... 10 2019 124 414.5

(51) Int. Cl.
*F41A 23/24* (2006.01)
*F41A 9/59* (2006.01)
(Continued)

(52) U.S. Cl.
CPC ..... *F41A 23/24* (2013.01); *F41A 9/59* (2013.01); *F41A 9/60* (2013.01); *F41A 27/18* (2013.01)

(58) Field of Classification Search
CPC ..... F41A 9/54; F41A 9/55; F41A 9/56; F41A 9/59; F41A 9/60; F41A 9/81
(Continued)

(56) References Cited

U.S. PATENT DOCUMENTS 4,430,820 A * 2/1984 Marsh ..... F41A 9/60 42/98
6,799,500 B1 10/2004 Kulikowski
(Continued)

FOREIGN PATENT DOCUMENTS

DE 102009051064 A1 5/2011
DE 10 2011 002 052 A1 10/2012
FR 29 77 018 A1 12/2012

OTHER PUBLICATIONS

International Search Report from corresponding PCT Application No. PCT/EP2020/071622, dated Oct. 14, 2020.
(Continued)

*Primary Examiner* — Bret Hayes
(74) *Attorney, Agent, or Firm* — Harness, Dickey & Pierce, P.L.C.

(57) ABSTRACT

The invention relates to a deflecting device for deflecting belt links of different ammunition, such as those used on vehicles for example. The deflecting device comprises at least one deflecting surface which is suitable for deflecting the belt links. The deflecting surface is arranged on an underlying surface which is designed to be soft and flexible. The deflecting device additionally comprises at least one securing element, and the deflecting device can thus be secured to a vehicle or a tower of a vehicle.

13 Claims, 3 Drawing Sheets

(51) Int. Cl.
*F41A 9/60* (2006.01)
*F41A 27/18* (2006.01)

(58) Field of Classification Search
USPC ..... 42/98; 89/34
See application file for complete search history.

(56) References Cited

U.S. PATENT DOCUMENTS 7,513,187 B1* 4/2009 Lambermont ..... F41A 27/14 89/37.02
8,091,463 B1* 1/2012 Moody ..... F41C 27/22 89/34
10,107,578 B1* 10/2018 Mirabel ..... F41A 9/60
2003/0221355 A1 12/2003 Castaldo
2009/0249947 A1* 10/2009 Coiffet ..... F41A 9/54 89/35.02
2010/0192760 A1 8/2010 Moody
2010/0294120 A1* 11/2010 Deckard ..... F41A 9/34 89/33.4
2013/0042747 A1 2/2013 Moody
2015/0253092 A1* 9/2015 Moskovitch ..... F41A 9/56 89/37.03
2015/0300761 A1 10/2015 Delury et al.
2017/0138700 A1* 5/2017 Devine ..... F41G 11/001
2019/0113295 A1* 4/2019 Larish ..... F41A 9/54
2019/0242664 A1 8/2019 Gritskevitch et al.
2020/0363149 A1* 11/2020 Baert ..... F41A 9/60

OTHER PUBLICATIONS

Summons to the Hearing from corresponding German Patent Application No. 102019124414.5, dated Nov. 22, 2022.
Examination Report from corresponding Australian Patent Application No. 2020346256, dated May 30, 2023.

* cited by examiner

DEFLECTING DEVICE

CROSS-REFERENCE TO RELATED APPLICATIONS

This application is a national phase application of PCT Application No. PCT/EP2020/071622, filed on 31 Jul. 2020, which claims benefit of German Patent Application No. 10 2019 124 414.5, filed on 11 Sep. 2019. The entire disclosures of the applications identified in this paragraph are incorporated herein by references.

FIELD

The present invention relates to a deflecting device for deflecting belt links of different ammunition.

BACKGROUND

Corresponding deflecting devices are required with pieces of ammunition of different weapon systems, which are connected to one another via belt links. In these weapon systems, the belt links, which are free from ammunition after firing, are ejected.

Weapon systems of this kind are frequently used on vehicles which have a mission module and a turret rotatably mounted thereupon. The weapon system in this case is associated with the turret.

In the simplest case, once the belt links have been ejected, they fall onto the mission module in an uncontrolled manner. Depending on the weapon system or the position of the turret in relation to the mission module, the ejected belt links can fall onto the ground, but it is not unusual for them to fall onto the mission module.

The fact that the ejected belt links are able to fall onto the mission module means that, when the turret rotates, there is a risk of said belt links getting between the turret and mission module. Consequently, the belt links can become jammed between the turret and the mission module and can cause substantial damage to the underside of the turret and to the mission module.

With this in mind, a corresponding throw-away device for belt links is known from DE 10 2009 031 285 A1, for example. A device of this kind ensures that belt links are ejected from the weapon or the turret after the ammunition has been fired. This first publication of the patent application proposes the option of a collecting device.

A catching or collecting device for this purpose for sleeves and/or connectors is known from DE 10 2009 051 064 A1. This publication proposes that corresponding catching and collecting containers should be provided, in order to gather ejected ammunition parts.

However, the problem associated with collecting containers is that they fill up after a given period of time and any further use of the weapon systems would cause the containers to overflow. Failing this, the weapon system must remain unused for a period of time, so that the container can be emptied.

SUMMARY

The problem addressed by the present invention is therefore that of preventing belt links of different ammunition from becoming jammed between the turret and the mission module of a vehicle and avoiding weapon system downtime, for example due to the emptying of collecting containers.

These problems are solved by the features of the present main claim.

The present application therefore recommends a deflecting device for deflecting belt links that have been ejected from different ammunition. The deflecting device has at least one deflecting surface for this purpose, and this deflecting surface is arranged on an underlying surface. The deflecting device furthermore comprises at least one fastening element, in order to fasten the deflecting device to a weapon system or a turret of a vehicle.

The basic idea underlying the present invention is that of creating a device which can reliably deflect ejected belt links from the region of the vehicle, and therefore of the turret and of the mission module. The ejected belt links therefore encounter the deflecting device and this ensures that the belt links are deflected outside the vehicle onto the ground on which the vehicle is also standing. Consequently, the belt links no longer get to the mission module and are no longer able to become jammed between the turret and the mission module. The weapon system downtimes that occur when collecting containers are used do not apply in this case.

In order to guarantee this kind of reliable deflection, the deflection device is configured in such a manner that the ejected belt links are conducted from the vehicle in a direction provided for this purpose. The deflecting device may either be structurally designed for this purpose, so that the ejection speed of the belt links means that they are guided in a particular direction on account of the geometry of the deflecting device and, in particular, the deflecting surface.

In each case, when the deflecting devices are mounted on the vehicle, they are configured in such a manner that they can project beyond the lateral dimension of the mission module of the vehicle.

In a preferred embodiment, the deflecting surface is configured in such a manner that it runs obliquely to the underlying surface on one side. The course of the deflecting surface to the underlying surface is then configured in such a manner that the distance to the underlying surface is kept small on the one side and the distance to the underlying surface is increased on the opposite side. The deflecting surface therefore runs obliquely to the underlying surface, as a result of which a deflection of the ejected belt links to one side of the deflecting device is guaranteed.

So that when the belt links are ejected, they cannot move out over the deflecting device, it is furthermore preferably provided that the deflecting device comprises peripheral surfaces. These are arranged laterally on the deflecting surface, wherein the side to which the ejected belt links are to be deflected, is left open.

The peripheral surfaces are tilted in towards the deflecting surface, so that guidance of the ejected belt links towards the deflecting surface is guaranteed. The ejected belt links then reach the deflecting device through the peripheral surfaces. Depending on the ejection speed, they will initially reach the peripheral surfaces, where appropriate, and they will be guided back from the peripheral surfaces to the deflecting surface. From the deflecting surface, the belt links are then guided away from the vehicle.

The deflecting surface itself may likewise be curved, but it may also have a straight design. The peripheral surfaces, which run in an angled and oblique fashion for this purpose, may form a U-shape along with the deflecting surface.

The peripheral surfaces are preferably arranged laterally on the deflecting surface, namely in such a manner that the peripheral surfaces run obliquely to the underlying surface. The distance from the underlying surface and peripheral surfaces to the deflecting surface is thereby reduced. In principle, the deflecting surface and peripheral surfaces form a U-shape, wherein the wings of the U do not run perpendicularly, but obliquely.

Furthermore, it is preferably proposed that at least one boundary is provided, which is assigned to at least one side of the deflecting surface and/or at least one side of the peripheral surfaces. Corresponding boundaries of this kind are configured as a vertical surface and ensure that a movement of the ejected belt links to a particular side of the deflecting device is limited. If the speed of the belt links should mean that they reach the boundary, they simply rebound off it and are therefore moved once again in the direction of the deflecting surface or peripheral surface.

So that damage to the deflecting device due to the ejected belt links is minimized as far as possible, it is proposed that the deflecting surface or the peripheral surfaces are made of hardened metal. It is important for the peripheral surfaces or the deflecting surface to be made of stronger or harder material than the ejected belt links.

The underlying surface of the deflecting device is soft, meaning that it can come into contact with the mission module located beneath the turret. During a rotational movement of the turret, unevennesses in the surface of the mission module can then be evened out by the soft material of the underlying surface. It is preferably proposed for this purpose that the underlying surface should be made of soft rubber.

The fact that the underlying surface can come into contact with the mission module means that the region between the turret and the mission module is protected, so that the ejected belt links cannot get into this region and become jammed therebetween.

So that the underlying surface is as soft as possible and a high deformability is guaranteed, it is proposed that the material of the underlying surface should be provided with recesses. Particularly when rubber is used, it thereby acquires a very high deformability and becomes very soft. Alternatively, it is proposed that the underlying surface should be made of soft foam material.

Due to the aforementioned features, it is possible for the deflecting device to transport or deflect the ejected belt links so far away from the vehicle that they cannot get into the region between the turret and the mission module. On the one hand, this occurs due to the fact that the physical dimensions of the deflecting device are such that the ejected belt links are conducted away from the region of the vehicle. On the other hand, the region at the ejection point of the belt links to the mission module is covered by the underlying surface, so that the belt links cannot get into this region.

It is preferably proposed that the aforementioned deflecting device for the deflection of belt links of different ammunition should be arranged on a vehicle. A vehicle of this kind contains a mission module, which also represents the chassis of the vehicle, and a turret, which is rotatably mounted on the mission module. This turret contains a weapon which has an ejection point for belt links from the weapon ammunition.

The proposed deflecting device is arranged on the turret, and fastened to said turret by means of fastening elements. The deflecting device is fastened to the turret in such a manner that the underlying surface is arranged towards the mission module. The aforementioned solution to the problem posed is reached by means of this arrangement.

The deflecting device is preferably fastened to the turret in the region of the ejection point.

When mounted on the turret, the aforementioned boundaries are preferably arranged on the sides of the deflecting surface or of the peripheral surfaces, which does not correspond to the side of the fastening. In other words, the side which is not facing the ejection point can be provided with corresponding boundaries.

The deflecting device fastened to the turret then creates a deflecting system, wherein the obliquely running deflecting surface is oriented away from the ejection point. This means that it falls away on a side other than the side facing the ejection point.

BRIEF DESCRIPTION OF THE DRAWINGS

Further features result from the attached drawing. In the drawing.

DETAILED DESCRIPTION

Figure 1:
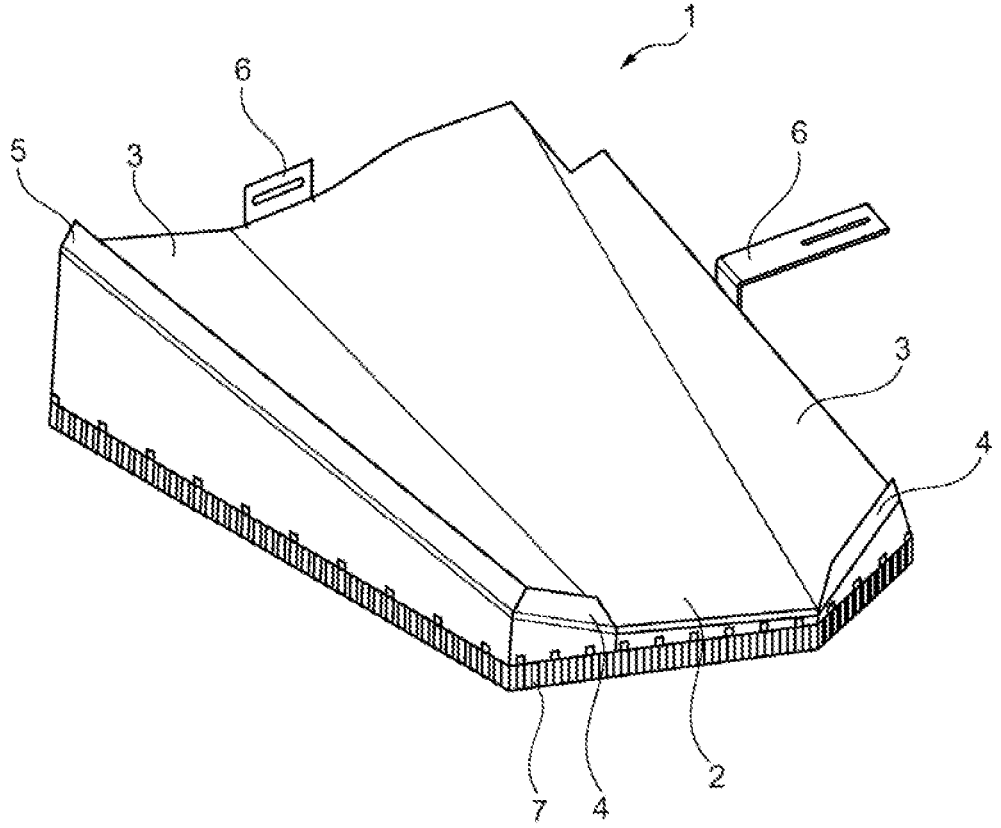
FIG. 1 shows a deflecting device 1 according to the invention in the dismantled state.
Figure 2:
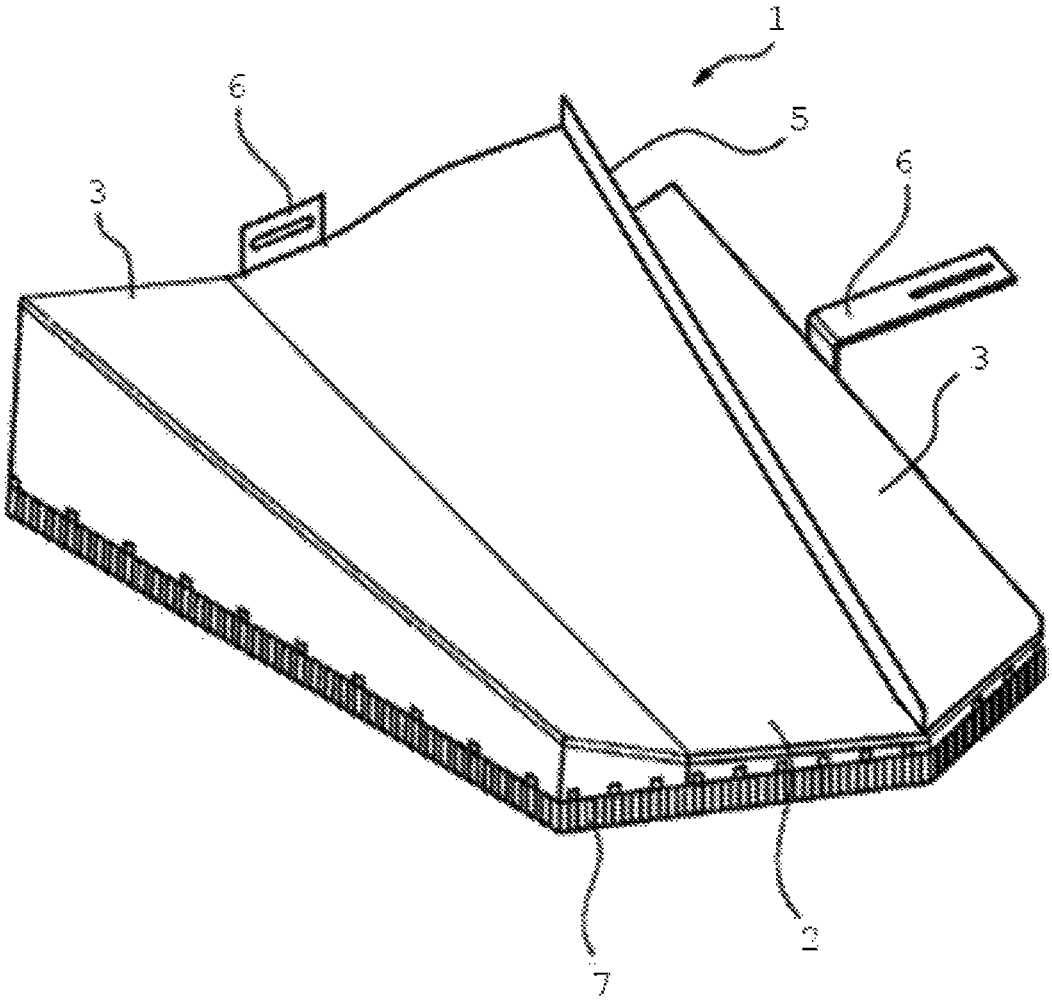
FIG. 2 shows another deflecting device 1 in the dismantled state, where the deflecting device 1 includes a deflecting surface 2 arranged on an underlying surface 7, peripheral surfaces 3, a boundary 5 arranged on a side of the deflecting surface 2, and fastening elements 6.
Figure 3:
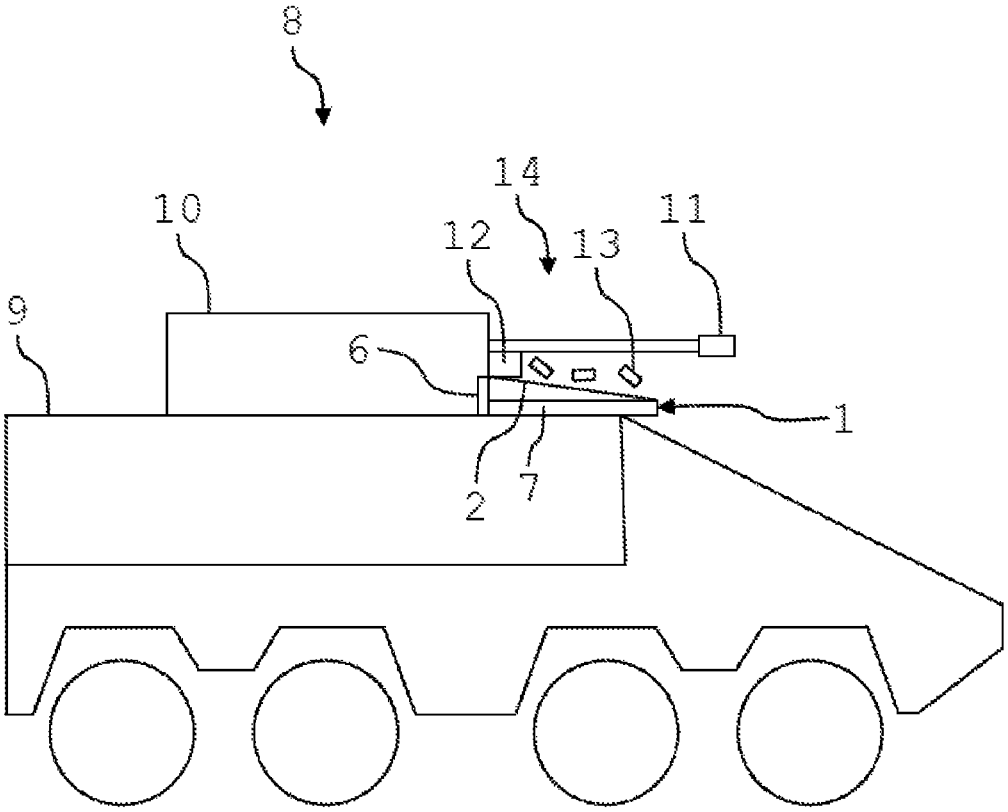
FIG. 3 shows a system including a vehicle 8 having a mission module 9, a turret 10 mounted rotatably on the mission module 9 and a weapon 11 with an ejection point 12 for belt links 13 from weapon ammunition, and a deflecting system 14 having a deflecting device 1 fastened to the turret 10 by a fastening element 6, a deflecting surface 2, and a underlying surface 7 arranged towards the mission module 9.

The deflecting device 1 for deflecting belt links of different ammunition comprises at least one deflecting surface 2. This deflecting surface 2 is arranged on an underlying surface 7, wherein the deflecting device 1 comprises at least one fastening element 6.

The deflecting device 1 is therefore primarily made up of the deflecting surface 2, which ensures that ejected belt links are guided to one side of the deflecting device 1.

The deflecting device 1 can be attached to the turret by means of the aforementioned fastening elements 6, so that it can receive the ejected belt links of the weapon.

The deflecting surface 2 is configured in such a manner for this purpose that ejected belt links which occur are deflected to one side. This can take place on account of the geometric shape of the deflecting surface 2. However, the deflecting surface 2 preferably runs obliquely to the underlying surface 7, so that ejected belt links are conveyed to the side under the effects of gravity, where the deflecting surface 2 is at the shortest distance from the underlying surface 7, this being the front side in the present drawing.

In order to support the geometry and the deflecting action of the deflecting surface 2, peripheral surfaces 3 can be provided which are arranged obliquely to the deflecting surface 2. The peripheral surfaces 2 therefore support the deflection of the ejected belt links to the deflecting surface 2.

Furthermore, boundaries 4, 5 are provided, in order to prevent the belt links from moving out of the deflecting device 1. Lateral boundaries 5 may be provided and also lower boundaries 4. The boundaries 4, 5 ensure that ejected belt links which encounter the deflecting device 1 cannot go beyond the dimensions of the deflecting device 1, since the movement is halted by the boundaries 4, 5. Corresponding belt links will then reach the peripheral surfaces 3 or the deflecting surface 2 once again.

While the lateral boundary 5 ensures that a movement outside the deflecting device is prevented, the lower boundary 4 ensures that the belt links are only deflected by the deflecting device 1 in the region of the deflecting surface 2. Any deflections via the peripheral surfaces 3 are thereby prevented.

The underlying surface 7 is provided with recesses, as depicted, so that it is softer in design than material without recesses, for example rubber. The soft underlying surface 7 ensures that the region from the turret to the mission module is filled in the region of the deflecting device 1. A rotational movement of the turret is, however, furthermore permitted due to the deformability of the underlying surface 7.

The present invention is not limited to the aforementioned features. Instead, multiple embodiments are conceivable.

The deflecting surface, and also the peripheral surfaces and the boundaries, where appropriate, can therefore be made of hardened metal. However, other hard materials can also be used. All that is required is for the hardness to be greater than that of the ejected belt links. The underlying surface could be made of another soft material, instead of rubber, such as foam material, for example. Furthermore, the fastening elements could be formed as the side surface of the deflecting surface or of the peripheral surfaces. In this way, the deflecting device can be attached to the turret via the side surface itself, for example by screw, clip or welded connections.

LIST OF REFERENCE SIGNS

1 Deflecting device
2 Deflecting surface
3 Peripheral surface
4 Lower boundary
5 Lateral boundary
6 Fastening element
7 Underlying surface

What is claimed is:

1. A system comprising:

a vehicle including a mission module, a turret mounted rotatably on the mission module, and a weapon which has an ejection point for belt links from weapon ammunition, and a deflecting device for deflecting the belt links, wherein the deflecting device comprises at least one deflecting surface and at least one fastening element, the deflecting surface is arranged on an underlying surface, the underlying surface is provided at a rear side of the deflecting surface, the deflecting device is fastened to the turret by means of the fastening element, and the underlying surface is arranged towards the mission module.

2. The system as claimed in claim 1, wherein the deflecting device comprises peripheral surfaces which are arranged laterally on the deflecting surface.

3. The system as claimed in claim 2, wherein the deflecting surface runs obliquely to the underlying surface, so that a distance from the underlying surface to the deflecting surface diminishes towards one side of the underlying surface.

4. The system as claimed in claim 2, wherein the peripheral surfaces run obliquely to the underlying surface, so that a distance from the underlying surface to the peripheral surfaces diminishes towards one side of the underlying surface and also towards the deflecting surface.

5. The system as claimed in claim 2, wherein at least one boundary is provided, which is arranged on at least one side of the deflecting surface or at least one side of the peripheral surfaces.

6. The system as claimed in claim 2, wherein the deflecting surface and/or the peripheral surfaces are made of hardened metal.

7. The system as claimed in claim 1, wherein the underlying surface is made of soft rubber.

8. The system as claimed in claim 7, wherein the underlying surface has recesses which allow the rubber to have greater deformability.

9. The system as claimed in claim 1, wherein the deflecting device is fastened to the turret on one side in a region of the ejection point.

10. The system as claimed in claim 9, wherein the deflecting device comprises a peripheral surface arranged laterally on the deflecting surface, and wherein at least one boundary is arranged on a side of the deflecting surface or a side of the peripheral surface, which does not correspond to the side facing the ejection point.

11. The system as claimed in claim 1, wherein the deflecting surface runs obliquely from the ejection point to the underlying surface, so that a distance from the underlying surface to the deflecting surface diminishes towards one side of the underlying surface.

12. The system as claimed in claim 1, wherein the underlying surface comes into contact with the mission module.

13. The system as claimed in claim 1, wherein at least one side of the deflecting device projects beyond the lateral dimension of the mission module.

* * * * *